US006874778B2

(12) United States Patent
Nakano et al.

(10) Patent No.: US 6,874,778 B2
(45) Date of Patent: Apr. 5, 2005

(54) SHEET FEEDING APPARATUS AND IMAGE FORMING APPARATUS PROVIDED WITH SAME

(75) Inventors: Yuji Nakano, Kawasaki (JP); Haruyuki Yanagi, Machida (JP); Hiroshi Yoshino, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 72 days.

(21) Appl. No.: 09/983,876

(22) Filed: Oct. 26, 2001

(65) Prior Publication Data

US 2002/0066994 A1 Jun. 6, 2002

(30) Foreign Application Priority Data

Oct. 31, 2000 (JP) ..... 2000-333515

(51) Int. Cl.[7] ..... B65H 7/12; B65H 3/06
(52) U.S. Cl. ..... 271/111; 271/122
(58) Field of Search ..... 271/110, 111, 271/121, 122

(56) References Cited

U.S. PATENT DOCUMENTS

| | | | | | |
|---|---|---|---|---|---|
| 4,494,747 | A | * | 1/1985 | Graef et al. | 271/263 |
| 4,761,002 | A | * | 8/1988 | Reed et al. | 271/111 |
| 4,919,412 | A | * | 4/1990 | Weigel et al. | 271/110 |
| 5,042,790 | A | * | 8/1991 | Miller et al. | 271/110 |
| 5,209,465 | A | * | 5/1993 | Sayama et al. | 271/110 |
| 5,316,285 | A | * | 5/1994 | Olson et al. | 271/122 |
| 5,370,380 | A | | 12/1994 | Suzuki et al. | 271/21 |
| 5,540,427 | A | | 7/1996 | Nitta et al. | 271/274 |
| 5,580,042 | A | | 12/1996 | Taniguro et al. | 271/274 |
| 5,620,174 | A | | 4/1997 | Taniguro et al. | 271/10.12 |
| 5,648,808 | A | | 7/1997 | Yanagi et al. | 347/104 |
| 5,655,762 | A | * | 8/1997 | Yergenson | 271/121 |
| 5,672,019 | A | | 9/1997 | Hiramatus et al. | 400/624 |
| 5,882,004 | A | * | 3/1999 | Padget | 271/119 |
| 5,918,873 | A | | 7/1999 | Saito et al. | 271/10.11 |
| 5,997,198 | A | * | 12/1999 | Murayama et al. | 400/624 |
| 6,161,829 | A | | 12/2000 | Kusumi | 271/9.05 |
| 6,168,270 | B1 | | 1/2001 | Saikawa et al. | 347/104 |
| 6,305,682 | B1 | | 10/2001 | Saito et al. | 271/10.11 |

FOREIGN PATENT DOCUMENTS

| | | | | |
|---|---|---|---|---|
| EP | 1201580 A2 | * | 5/2002 | B65H/3/52 |
| KR | 1999-0072708 | | 9/1999 | |

* cited by examiner

*Primary Examiner*—Kathy Matecki
*Assistant Examiner*—Mark A. Deuble
(74) *Attorney, Agent, or Firm*—Fitzpatrick, Cella, Harper & Scinto

(57) ABSTRACT

A sheet feeding apparatus has a sheet stacking portion for stacking sheets; a sheet feeding roller for feeding the sheets from the sheet stacking means; a separating portion for separating the sheets one by one; a returning claw for returning the sheet other than the sheets separated by the separating portion toward the sheet stacking portion; wherein the returning claw effects its sheet returning operation when the sheet other than the sheet separated from the separating portion passes through a predetermined position.

32 Claims, 7 Drawing Sheets

SHEET FEEDING APPARATUS AND IMAGE FORMING APPARATUS PROVIDED WITH SAME

FIELD OF THE INVENTION AND RELATED ART

The present invention relates to a sheet feeding apparatus and an image forming apparatus provided with the same, and more particularly to a sheet feeding apparatus having a sheet returning mechanism for preventing double feeding of sheets, and an image forming apparatus provided with such a sheet feeding apparatus.

Heretofore, an image forming apparatus such as a printer has been provided with a sheet feeding apparatus for feeding ion seriatim the sheets to an image formation station such as a recording station. In such a sheet feeding apparatus, a sheet feeding roller is press-contacted to the sheet to impart a feeding force, while separating means including a separation pad, a separation claw, and a separation bank imparts a load against the feeding, by which the sheet to be fed is separated from the remaining sheets and conveyed.

In known examples of such a sheet feeding apparatus, after the sheet separating action, the additional sheet or sheets fed out unintentionally are returned to the sheet stacking portion from which the sheet or sheets have been fed out, while aligning the leading-edge or edges with the rest of the sheets therein (sheet returning mechanism). For the purpose of compatibility between the separation performance and the sheet feeding speed, the sheet returning operations are effected periodically (selectively). In other words, they are effected each time a predetermined number of sheets are fed out.

In prior art devices having such a structure, the sheet returning operations are carried out periodically even though the number of sheet returning operations may change depending on the selection of printing modes. In order to assure the prevention of double feeding despite variations depending on the differences of the sheet materials, printing modes, and operating environment, it is required to determine the number of sheet returning operations with an ample margin.

With such an ample margin, the sheet feeding speed must be decreased. Additionally, when the periodical sheet returning operations are employed, occurrence of double feeding attributable to an unexpected cause cannot be avoided.

SUMMARY OF THE INVENTION

Accordingly, it is a principal object of the present invention to provide a sheet feeding apparatus and an image forming apparatus provided with a sheet feeding apparatus, wherein double feeding can be avoided.

According to an aspect of the present invention, there is provided a sheet feeding apparatus comprising sheet stacking means for stacking sheets; sheet feeding means for feeding the sheets from said sheet stacking means; separating means for separating the sheets one by one; returning means for returning to the sheet stacking means each sheet other than the sheet separated by separating means, the returning means operating only at predetermined timing; wherein said returning means effects its sheet returning operation when the sheet other than the sheet separated from said separating means passes through a predetermined position at a timing other than the predetermined timing.

According to another aspect of the present invention, there is provided a sheet feeding apparatus comprising sheet stacking means for stacking sheets sheet feeding means for feeding the sheets from said sheet stacking means; separating means for separating for separating the sheets one by one; returning means for returning the sheet other than the sheet separated by separating means toward said sheet stacking means; sheet end detecting means for detecting a leading-edge and a trailing-edge of the sheet separated by said separating means; wherein a sheet returning operation is carried out by said returning means in accordance with a length of the sheet calculated by said sheet end detecting means.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

First Embodiment

Figure 1:
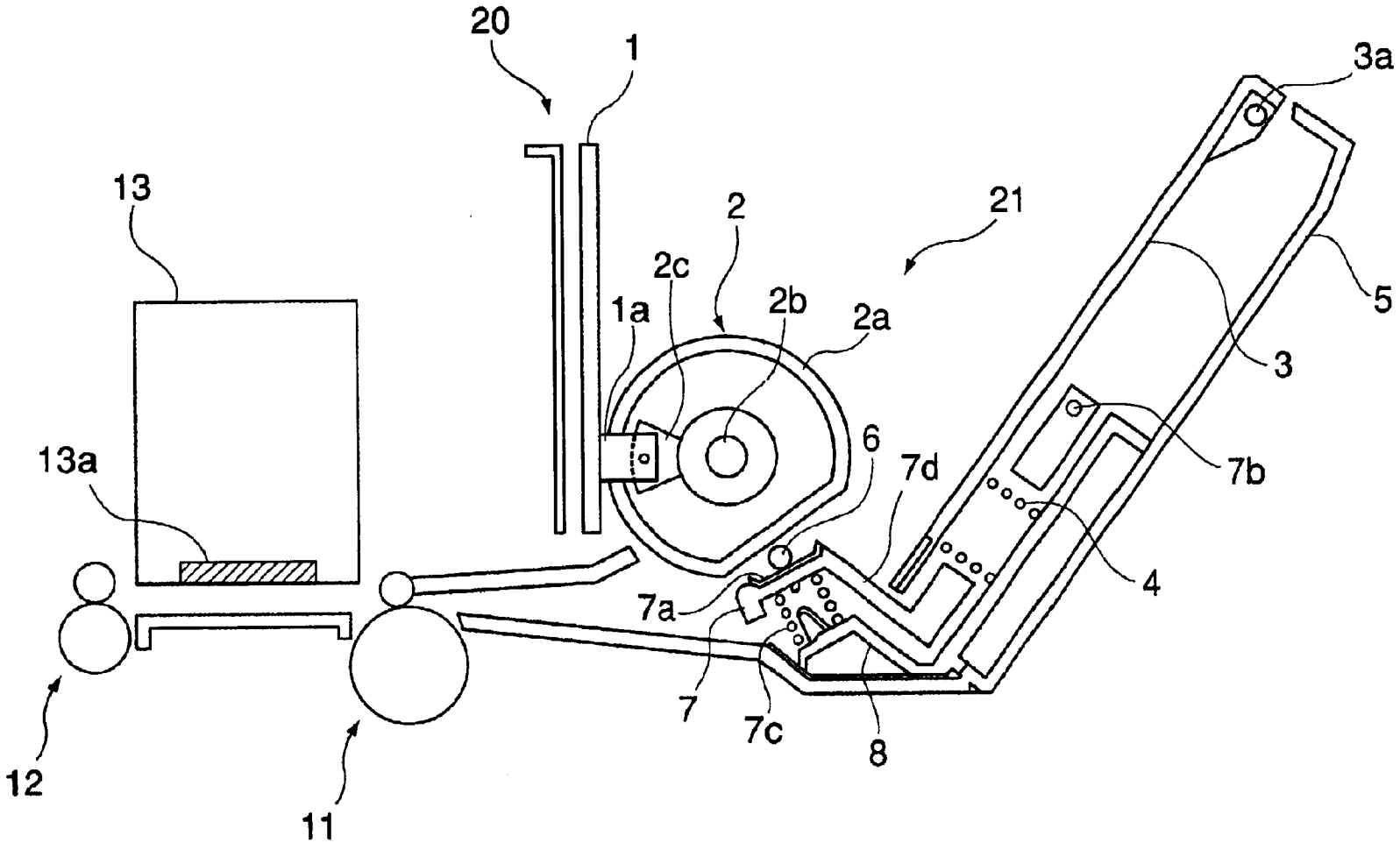
FIG. 1 is a schematic sectional view of a recording device according to a first embodiment of the present invention.
Figure 2:
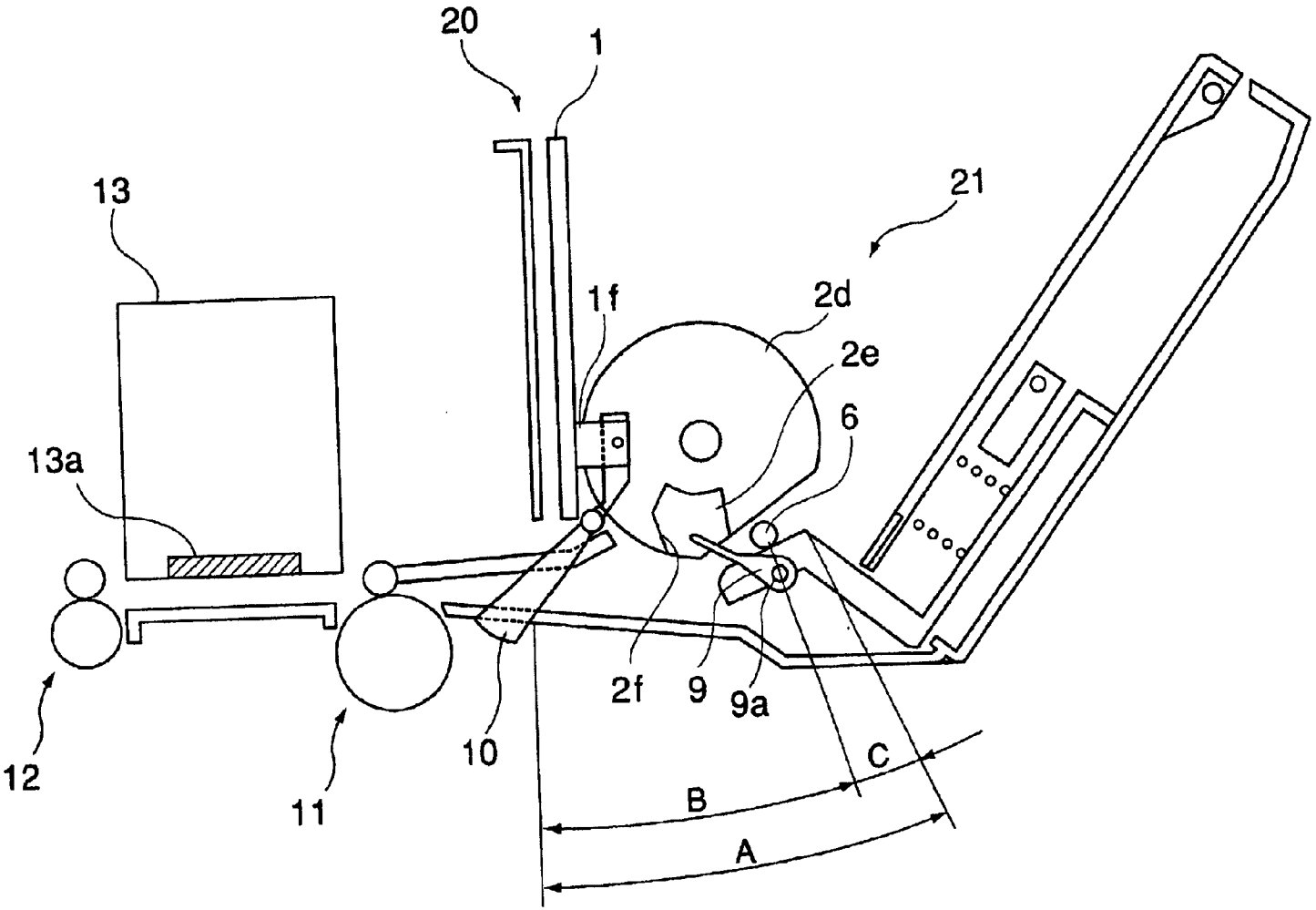
FIG. 2 is a schematic sectional view of the recording device.

FIG. 1 is a schematic sectional view of a recording device according to an exemplary image forming apparatus, and FIG. 2 is a schematic sectional view of the recording device. In FIG. 1, designated by 20 is a recording device which comprises a recording head unit 13 which is an image formation station having a recording head 13*a*, a sheet feeding apparatus 21 for feeding a sheet to a position facing the recording head unit 13, and a main board 1 for controlling the entire recording device.

Here, the sheet feeding apparatus 21 comprises a sheet feeding roller 2 which has a half-moon cross-section and which functions as sheet feeding means for picking up the sheet stacked on a sheet stacking portion; a hopper 3 for press-contacting the sheet to the sheet feeding roller 2; and a pad portion 7 having a separation pad 7*a* which serves as a separating means for separating the sheet picked up by the sheet feeding roller 2.

The sheet feeding roller 2 has a roller rubber 2*a* contactable to the surface of the sheet, a roller shaft 2*b* providing a center of rotation, a sensor flag 2*c* for blocking a transparent type sheet feeding roller sensor 1*a* which functions as position detecting means provided on a main board 1 to detect a position of the sheet feeding roller 2, and a cam (not shown) to effect a lowering of the hopper 3. They are rotatable together about the axis of the roller shaft 2*b*.

The hopper 3 is movable in interrelation with rotation of the sheet feeding roller 2 toward and away from the sheet feeding roller 2, so that sheet is press-contacted to the sheet feeding roller 2 by the elastic force of the press-contact spring 4 only when an arcuate portion of the roller rubber 2*a* is facing the sheet. The motion of the hopper 3 toward and away from the sheet feeding roller 2 is effected by the cooperation of the cam of the sheet feeding roller 2 and the press-contact spring 4.

Designated by reference numeral 5 is a base rotatably supporting the hopper 3 through shaft 3*a*. Designated by reference numeral 8 is a separation base supported for movement in a direction perpendicular to a sheet fitting direction (widthwise direction of the sheet). The separation pad portion 7 is mounted on the separation base 8 for pivoting motion about an axis of a rotational shaft 7*b*. Designated by 7*c* is a separation pad spring which urges the separation pad portion 7 toward the sheet feeding roller 2.

FIG. 1 shows the state in which the sheet is being picked up. In this state, the flat surface portion of the sheet feeding roller 2 and the separation pad 7*a* are substantially parallel with each other, and the separation pad 7*a* is kept away from the sheet feeding roller 2 by an unshown stopper portion. Only a neighborhood of a circumferential portion of the sheet feeding roller 2 is about the date to the separation pad 7*a*.

Designated by a reference numeral 6 is a roller providing a stock position at which the sheet is stopped by abutment against separation pad 7*a*. The roller 6 is provided at a position offset from the position of the sheet feeding roller 2 in the widthwise direction of the sheet, and is pressed against the separation pad 7*a* by an unshown spring lightly so that rotation thereof is not disturbed. By the light pressing of the roller 6 to the separation pad 7*a*, the second and subsequent sheets which tend to move together with the sheet intended to be fed out, are constrained by the separation pad 7*a*.

In FIG. 2, reference numeral 9 designates a returning claw (sheet returning means). The returning claw 9 is disposed at a position deviated from the position of the sheet feeding roller 2 and from the position of the roller 6 in the widthwise direction of the sheet, and is rotatably supported on the separation base 8 through the rotational shaft 9*a*. The returning claw 9, when the sheet is fed, is in a horizontal position as shown in FIG. 2. However, when the sheet returning action is effected and when the sheet feeding starts, it is retained at the position substantially perpendicular to the separation pad 7*a* by unshown spring and stopper.

In FIG. 2, designated by 2*d* is a returning claw cam portion which is disposed at a side of the sheet feeding roller 2 and which is provided with a recess 2*e* formed therein. When the returning claw 9 takes a position substantially perpendicular relative to the separation pad 7*a*, the select returning action is to be carried out. Before the start of the sheet feeding, the free end potion of the returning claw 9 enters the recess 2*e*.

Designated by 11 is a pair of feeding rollers which is feeding means for feeding the picked-up sheet, and 12 is a pair of sheet discharging rollers for discharging out of the apparatus the sheet on which the image is printed. Designated by 1*f* is a sheet end sensor of a transparent type (PE sensor) which is provided on the main board and which functions as sheet end detecting means for detecting a leading end of the sheet, and designated by 10 is an actuator which is pushed by the sheet which is being fed. The sheet end sensor 1*f* detects the leading end and trailing end of the sheet by rotation of the actuator 10.

Figure 3:
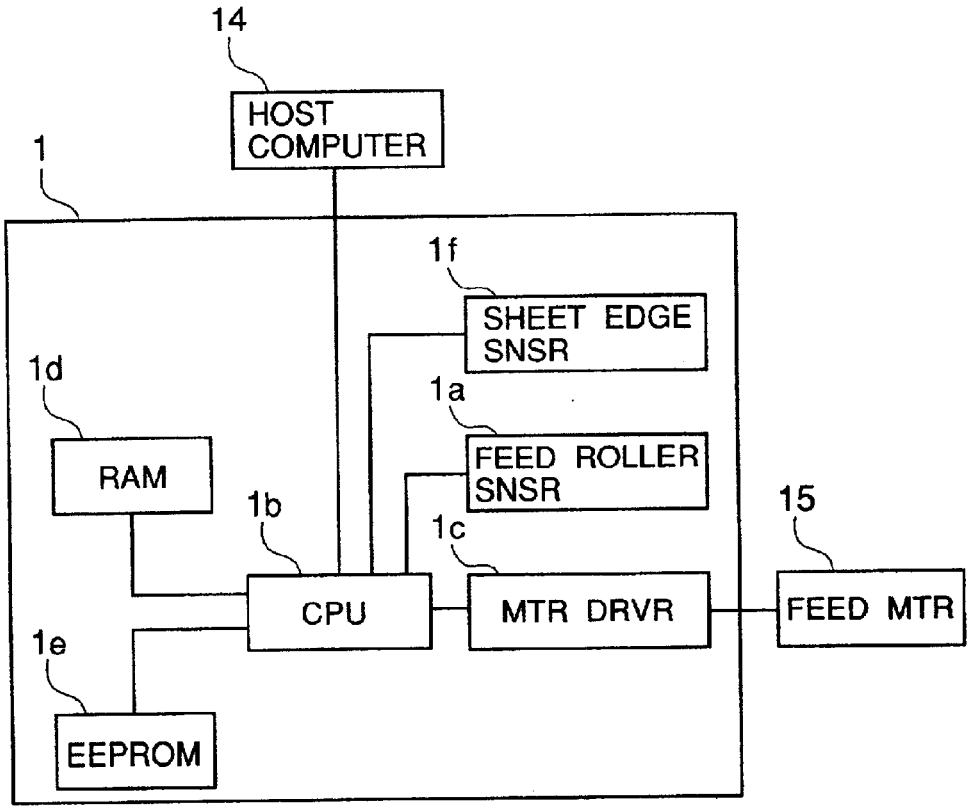
FIG. 3 is a control block diagram of the recording apparatus.

FIG. 3 illustrates a structure of a motor control circuit for actuating the sheet feeding motor for rotating the sheet feeding roller 2. Designated by 15 is a sheet feeding motor (stepping motor) for rotating the sheet feeding roller 2.

Designated as 1*b* is a CPU, which serves as a control means, is disposed on the main board 1, as is for controlling the entirety of the recording apparatus and for controlling the sheet returning operation of the returning claw 9; designated as 1*c* is a motor driver for controlling the sheet feeding motor 15, designated as 1*d* is a RAM for storing a temporary constant; and designated as 1*e* is an EEPROM for storing operational parameters of the recording device 20 such as a control table for the motor 15 or the like.

Designated by reference numeral 14 is an internal or external host computer, which supplies recording instructions to the CPU.

The description will be made as to a normal sheet feeding operation in the above-described recording device 20.

When the recording instructions is fed to the CPU from the host computer 14, the CPU discriminates whether or not the instructions are for the first sheet. If so, the returning claw 9 is at the perpendicular position, that is, the returning claw 9 is substantially perpendicular relative to the separation pad 7*a*, and therefore, the motor driver 1*c* causes the sheet feeding motor 15 to rotate in the forward direction to rotate the sheet feeding roller 2 in the forward direction. Then, the returning claw 9 is moved to the sheet feeding position (horizontal position as shown in FIG. 2).

Then, the returning claw 9 is moved to the sheet feeding position to enable the sheet to be fed out, and the sheet feeding motor 15 continues to rotate in the forward direction, by which the feeding of the sheet by the sheet feeding roller 2 is started. When the sheet feeding roller 2 is rotated in this manner, the contact between the cam portion and the hopper 3 is released so that hopper 3 is urged by the press-contact spring 4 toward the sheet feeding roller 2. In this state, the rotating sheet feeding roller 2 feeds several top ones of the sheets to the separation pad portion 7.

Here, the leading-edges of the stacked sheets generally abut the rear wall 7*d* of the separation pad portion 7 shown in FIG. 1, and several sheets are fed out from such positions. At this time, the sensor flag 2*c* is also rotated together with the rotation of the sheet feeding roller 2 so that output of the sheet feeding roller sensor 1*a* changes from "on" to "off". The CPU 1*b* uses the position where the output of the sensor changes as a starting point of the amount of operation of the roller rotation.

On the other hand, the fed sheet reaches the nip between the sheet roller 2 and the separation pad 7*a*, at which time the sheet subsequent to the topmost one of the sheets is stopped by the separation pad 7*a* at its leading-edge, so that only the topmost sheet is singled out while the leading-edge portions are forming into a wedge and is fed to bottom left direction in FIG. 1. At this time, the returning claw 9 is pushed by the leading-edge of the sheet to be rotated in the counterclockwise direction so as not to obstruct the motion of the sheet.

Then, the leading-edge of the topmost sheet thus singled out reaches the actuator 10 and rotates the actuator 10. With this, the end portion of the actuator 10 is out of the light blocking portion of the sheet end sensor 1*f*, by which the sheet end sensor 1*f* can detect the leading-edge of the sheet.

In this embodiment, the inclination of the sheet is corrected by the pair 11 of feeding rollers. The CPU uses the detection signal from the sheet end sensor 1*f* as the starting point of the operation amount or the distance through which the sheet is fed to the pair 11 of feeding roller and is fed enough to form a loop of sheet in contact with the pair 11 of feeding rollers. Thus, when the sheet feeding roller 2 rotates further, the leading-edge of the sheet fed into the recording device is brought into abutment with the nip formed by the feeding rollers 11. The sheet is further fed through 3 mm approx. for inclination correction to form a loop. Then, the rotation of the motor temporarily stops. The distance through which the sheet is fed until this point of time is constant from the free end detection of the sheet as described hereinbefore.

Then, the pair 11 of feeding roller and sheet feeding roller 2 start to rotate at the same peripheral speeds, and immediately thereafter, the leading-edge of the sheet is fed between the feeding rollers 11. Furthermore, an unshown cam of the sheet feeding roller 2 lowers the hopper 3 so that sheet feeding roller 2 stops in the state shown in FIG. 1, by which the sheet feeding operation ends. At this time, the sheet feeding roller 2 is stopped on the basis of the starting point determined by actuation of the flag of the sheet feeding roller sensor 1*a*. The stopping operation may be based on the deactuation of the rotation starting flag.

Thereafter, the sheet is fed downstream by the pair 11 of feeding rollers driven by an unshown driving source, so that sheet pops out partially, and simultaneously therewith, the printing its effected on the sheet by the recording head 13*a*. The recording position at this time is controlled by the distance of feed by the pair 11 of feeding roller after the abutment to the feeding roller.

During the operation, the sheets other than the topmost sheet are going to be moved by the friction relative to the topmost sheet, but the leading-edge thereof is stopped by the press-contact portion (stop position) between the roller 6 and the separation pad 7*a*, and therefore, they are not further fed. Thus, the generation of double feeding can be prevented.

However, if a sheet or sheets other than the topmost sheet pass through the press-contact portion (stop position) between the roller 6 and the separation pad 7*a* (particularly, more than two sheets), there exists nothing functioning to constrain the sheets, with the result that double feeding occurs due to the friction between the topmost sheet and the rest of the sheets. Once this occurs, the roller 6 is raised by the sheet, with the result of increase of the number of sheets passing through the nip.

Therefore, when the recording operation is carried out on two or more sheets, the returning claw 9 functions to return the rest of the sheets to prevent such a double feeding. When, however, the recording is effected on plain paper, for example, the separation is relatively stable, and the number of sheets is large. Therefore, the priorities placed on the recording speed to reduce the number of time-consuming sheet returning operations, to once per seven sheets, for example. When the recording is effected on the other sheets, such as special paper, the frequency of the sheet returning operations with increased to once per one sheet, for example.

The description will be made as to the operation of the sheet returning when the recording operation is effected continuously on two or more sheets.

When the sheet returning operation is carried out, the sheet feeding roller 2 is rotated through approx. 90° in the backward direction (reversed), after the trailing edge of the previous sheet is away from the separation pad portion 7 and the sheet end detection sensor 1*f* detects the trailing edge of the previous sheet. At this time, there is no sheet on the returning claw 9, and therefore, the returning claw 9 takes a horizontal position (sheet feeding position) as shown in FIG. 2, in which it is in the recess 2*c* of the cam portion 2*d* of the returning claw of the sheet feeding roller 2. Therefore, when the sheet feeding roller 2 rotates in the backward direction, the returning claw 9 abuts the left-hand end portion 2*f* of the recess 2*e*, so that returning claw 9 rotates in the clockwise direction. When the returning claw 9 rotates in the clockwise direction, the returning claw 9 becomes substantially perpendicular to the separation pad 7*a*, and therefore, the sheet which is confined by the roller 6 is pushed back to such an extend that the leading-edge thereof almost abuts the rear wall 7*d* of the separation pad 7*a*.

The position of the leading-edge of the sheet is reset, thus establishing the state in which double feeding does not easily occur, and only then the sheet feeding is started. At this time, the separation pad 7 and the roller 6 are spaced apart at proper timing so as to avoid obstructing the sheet returning operation.

On the other hand, when the recording is effected on plain paper or the like, and the sheet returning operation is not carried out, the sheet feeding it started when the leading-edge of the sheet is in the neighborhood of the roller 6. After the sheet returning operation is carried out, the sheet other than the topmost sheet may passes through the nip formed between the roller 6 and the separation pad 7*a* for some reason or another. If it occurs, the double feeding is likely to occur.

In view of this, in this embodiment, the sheet returning operation is carried out at a time different from the predetermined timing of the sheet returning operations whenever a sheet other than the topmost sheet passes through the nip between the roller 6 and the separation pad 7*a*, and the double feed event is detected.

In this embodiment, the event is discriminated from the timing of the detection of the sheet leading-edge by the sheet end sensor 1*f*.

The description will be made as to the detection of the leading-edge of the sheet.

Normally, upon the sheet feeding after the sheet set and the operation of the sheet returning, the leading edge of the sheet is in the neighborhood of the rear wall 7*d* of the separation pad 7*a*, and therefore, the sheet reaches the sheet end sensor 1*f* by feeding through a distance A from the start of the feeding of the sheet feeding roller 2, as shown in FIG. 2. On the other hand, when the sheet returning operation is not carried out, the feeding operation is started with the leading edge of the sheet being at the neighborhood of the roller 6. Therefore, the leading edge of the sheet reaches the sheet and sensor 1*f* by feeding only through a distance B.

Therefore, by detecting the timing of the leading edge of the sheet reaching the sheet end sensor 1*f*, the position of the leading edge of the sheet before the sheet feeding can be detected. In the system as in this embodiment, the double feeding tends to occur when the sheet exceeds the roller 6. In view of this, it is deemed that double feeding is likely to occur when the detected value is not more than B (with a proper margin). In this case, the sheet returning operation is carried out before the start of the next sheet feeding, even when it is not the timing of the predetermined sheet returning operation. By detecting the position of the leading edge of the sheet before the feeding in this manner, the likelihood of double feeding can be predicted.

More particularly, assuming that position (angle) and of the start of rotation of the sheet feeding roller 2, the timing at which the leading edge of the sheet reaches the sheet end sensor 1*f* can be detected by detecting the number of the steps from the start of the rotation of the sheet feeding roller 2.

When the position (angle) of the start of the rotation of the sheet feeding roller 2 is not construct, the accurate control is accomplished by detecting the number of steps with the start point being at the sheet feeding roller sensor 1*a*.

On the other hand, the topmost sheet and a part of the rest of the sheets may be passed through the nip formed between the roller 6 and the separation pad 7*a* (double feed) for some reason or another. In such a case, the double feeding is discriminated by detecting the length of the sheet.

In this embodiment, the sheet length is detected by detecting the leading-edge and trailing-edge of the sheet. The occurrence of the double feed can be detected on the basis of the comparison between the sheet length thus detected and the data relating to the sheet length stored in the RAM 1*d* which serves as an initial storing means, the data having been supplied from the host computer, the data having been supplied from the host computer, for example. When the double feed occurrence is carried out before the feed of the next sheet, in order to prevent the occurrence of double feed upon the next sheet feeding.

In this embodiment, the registration is accomplished by abutting the leading edge of the sheet against the nip formed between the feeding rollers which are at rest. Therefore, the measured length (E) is a sum of the feeding length (operation distance) of the pair 11 of feeding rollers from the leading edge of the sheet abutting the nip formed between the feeding rollers 11 after the sheet end sensor 1*f* detecting the leading edge of the sheet to the sheet end sensor 1*f* detecting the trailing edge of the sheet, and a distance between the sheet end sensor 1*f* and the nip between the feeding rollers.

Figure 4:
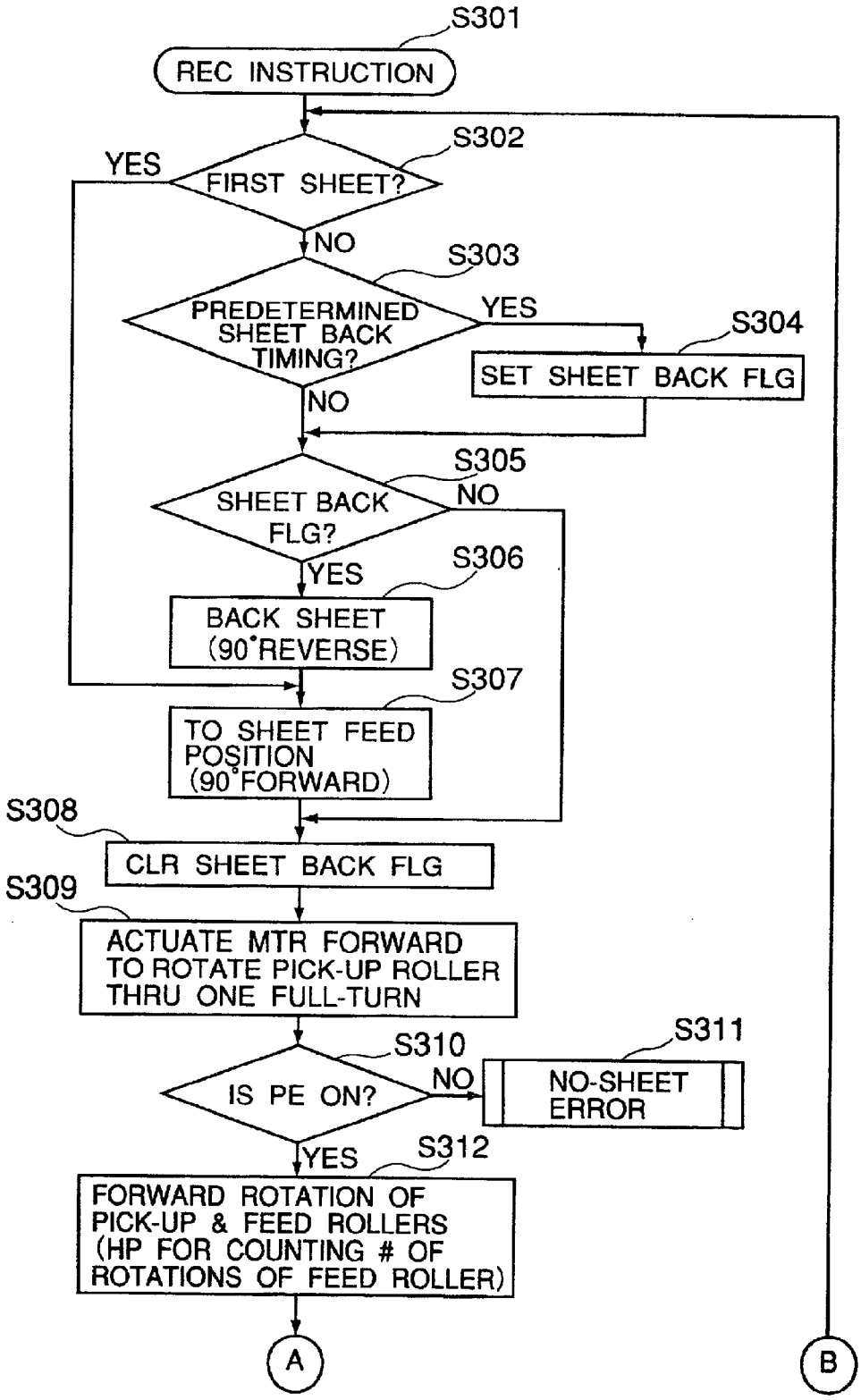
FIG. 4 is a flow chart of a part of a recording operation control of the recording device.
Figure 5:
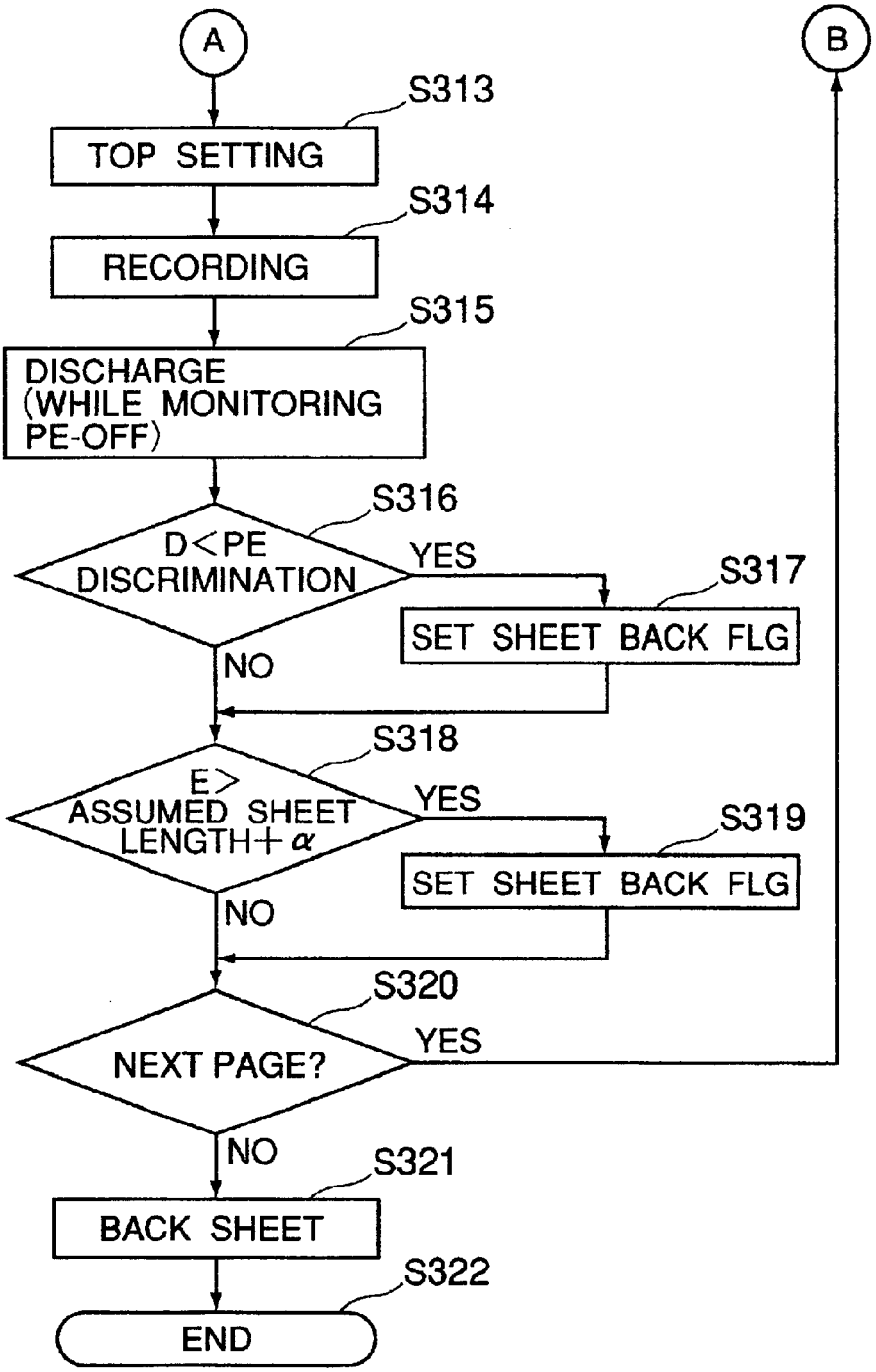
FIG. 5 is a flow chart of a part of a recording operation control of the recording device.

Referring to FIGS. 4 and 5, the description will be made as to sheet feeding operation of the recording device 20 of such structures.

When the host computer 14 produces recording instructions to CPU 1*b* (S301), the CPU 1*b* first discriminates whether the instructions are for the first sheet or not (S302). If the instructions are for the first sheet (Y in S302), the motor driver 1*c* rotates the sheet feeding motor 15 in the forward direction to move the returning claw 9 to the sheet feeding position shown in FIG. 1.

Subsequently, the sheet returning requesting flag is cleared (S308), and the sheet feeding motor 15 is further rotated in the forward direction to rotate the sheet feeding roller 2 through one full-turn. By doing so, the sheet feeding operation is started so that topmost one of the sheets is fed to the separation pad portion 7. The leading edge of the sheet stacked at this time is abutted to the rear wall 7*d* of the separation pad portion 7, and the sheet begins to be fed from that position. In this case, the sensor flag rotates with the rotation of the sheet feeding roller by which the output of the sheet feeding roller sensor 1*a* changes from OFF state to ON state.

The feeding thus fed out reaches the nip formed between the sheet feeding roller 2 and the separation pad 7*a*, the sheets below the topmost sheet are stopped by the separation pad so that leading-edge portions of the rest sheets form into a wedge, and finally only the topmost sheet is singled out and fed to the downstream. Then, the leading edge of the sheet reaches the actuator 10, so that actuator 10 is rotated, and the sheet end sensor 1*f* detects the leading-edge of the sheet. That is, the sheet end sensor 1*f* is actuated, that is, becomes "on" (S310). If the sheet end sensor 1*f* is not actuated (N in S310), no sheet is discriminated, and error clearance operation is carried out.

Thereafter, when the sheet feeding roller 2 rotates further, the leading edge of the sheet fed into the recording apparatus is brought into abutment with the nip formed between the feeding rollers 11 while these rollers are at rest, and the sheet is fed further by approx. 3 mm to correct inclination of feeding, and then the rotation of the motor temporarily stops.

Then, the pair 11 of feeding roller and sheet feeding roller 2 start to rotate at the same peripheral speeds (S312), and immediately thereafter, the leading-edge of the sheet is fed between the feeding rollers 11. Furthermore, an unshown cam of the sheet feeding roller 2 lowers the hopper 3 so that sheet feeding roller 2 stops in the state shown in FIG. 1, by which the sheet feeding operation ends. At this time, the sheet feeding roller 2 is stopped on the basis of the starting point determined by actuation of the flag of the sheet feeding roller sensor 1*a*.

The sheet fed into the recording device is fed by the feeding rollers 11 driven by an unshown driving source so that sheet pops out partially (S313), and simultaneously therewith, the recording is effected on a sheet by the recording head 13*a*. After the recording operation thereon, the sheet is discharged. At this time, the sheet end sensor (PE) becomes "off", upon which the jam occurrence is checked (S315). On the other hand, if the recording instructions have not for the first sheet (N in S302), the discrimination is made as to whether or not it is predetermined sheet returning timing, more particularly, whether or not it is the seventh sheet (S303) in this embodiment. If so (Y in S303), the sheet returning requesting flag is set (S304). When the setting of the sheet returning requesting flag is detected (Y in S305), the sheet feeding motor 15 is rotated reversely through the motor driver 1*c*, so that returning claw 9 is moved from the sheet feeding position shown in FIG. 1 to the claw returning position.

Thereafter, the sheet feeding motor 15 is rotated in the forward direction, the returning claw 9 is returned to the sheet feeding position, and then, the sheet returning requesting flag is cleared (S308), and the operations of steps S309–S315 are carried out.

As described hereinbefore, after the sheet is discharged, the feeding distance D from the "OFF" state of the sheet feeding roller sensor 1*a* to the "ON" state of the sheet end sensor is detected by the number of steps of the sheet feeding motor 15. If the distance D is not more than B (PE discrimination value) (Y in S316), it is deemed that the likelihood of double feeding is high, and therefore, the sheet returning requesting flag is set (S317).

The comparison is made between the data relating to the sheet length supplied from the host computer and the actual measured length E of the sheet, and if the actually measured length E is longer than the sheet length data supplied from the host computer (set sheet length) plus $\alpha$ (Y in S3218), it is discriminated that double feeding has occurred, and the sheet returning requesting flag is set (S319).

Then, with the sheet returning requesting flag set by the two space, if there are recording instructions for the next sheet (Y in S320), the sheet returning operation is carried out before the feeding of the next sheet, irrespective of whether or not the next is the predetermined timing for the sheet returning operation (S306).

In this number, when the liability of the double feed is high or when the double feed is detected, the sheet returning operation is carried out. By doing so, the number of sheet returning operations can be reduced without losing the desirable sheet feeding performance. In other words, the double feed can be avoided without losing the sheet feeding speed.

When the sheet delivery by the sheet feeding roller 2 is started, the timing at which the sheet starts to move is different depending on the amount of sheets stacked. That is, when the stacked amount is large, the sheets start to move quickly, and when the stack amount is small, the start of sheet movement is delayed. This is different depending on the profile of the cam. In the system in which the cam gradually raises the hopper, the timing at which the rubber and the sheet are contacted is different. When the timing of start of the sheet is different, the sheet and detection timing is different.

In view of this, the use can be made with a constant discrimination value. In a preferable alternative, the detecting timing of the leading edge of the sheet upon the immediately previous sheet returning operation (A value) is stored, and the discrimination is made on the basis of B (proper margin should be added) provided by deducting C shown in FIG. 2 therefrom.

Second Embodiment

Figure 6:
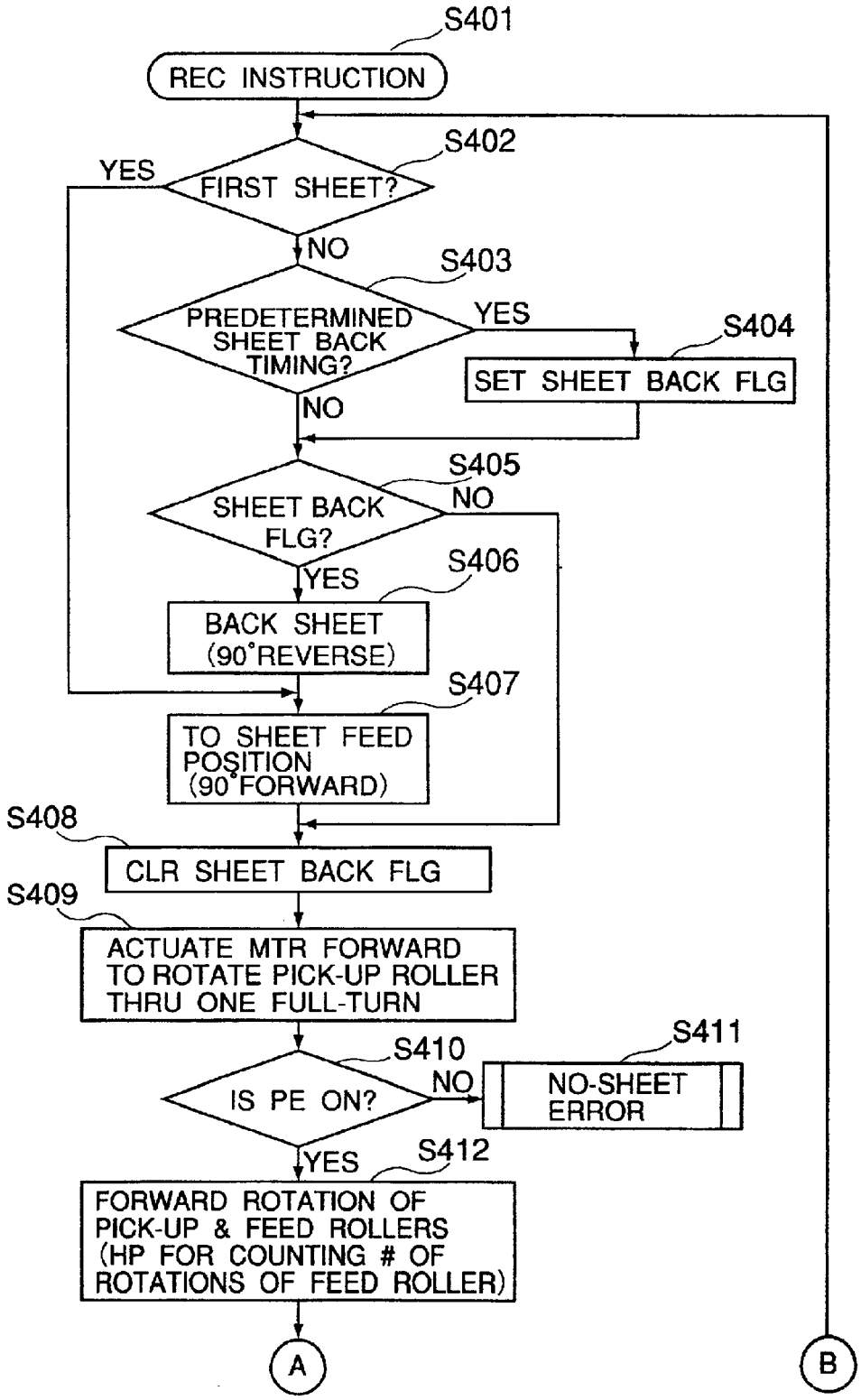
FIG. 6 is a flow chart of a part of a recording operation control of a recording device according to a second embodiment of the present invention.
Figure 7:
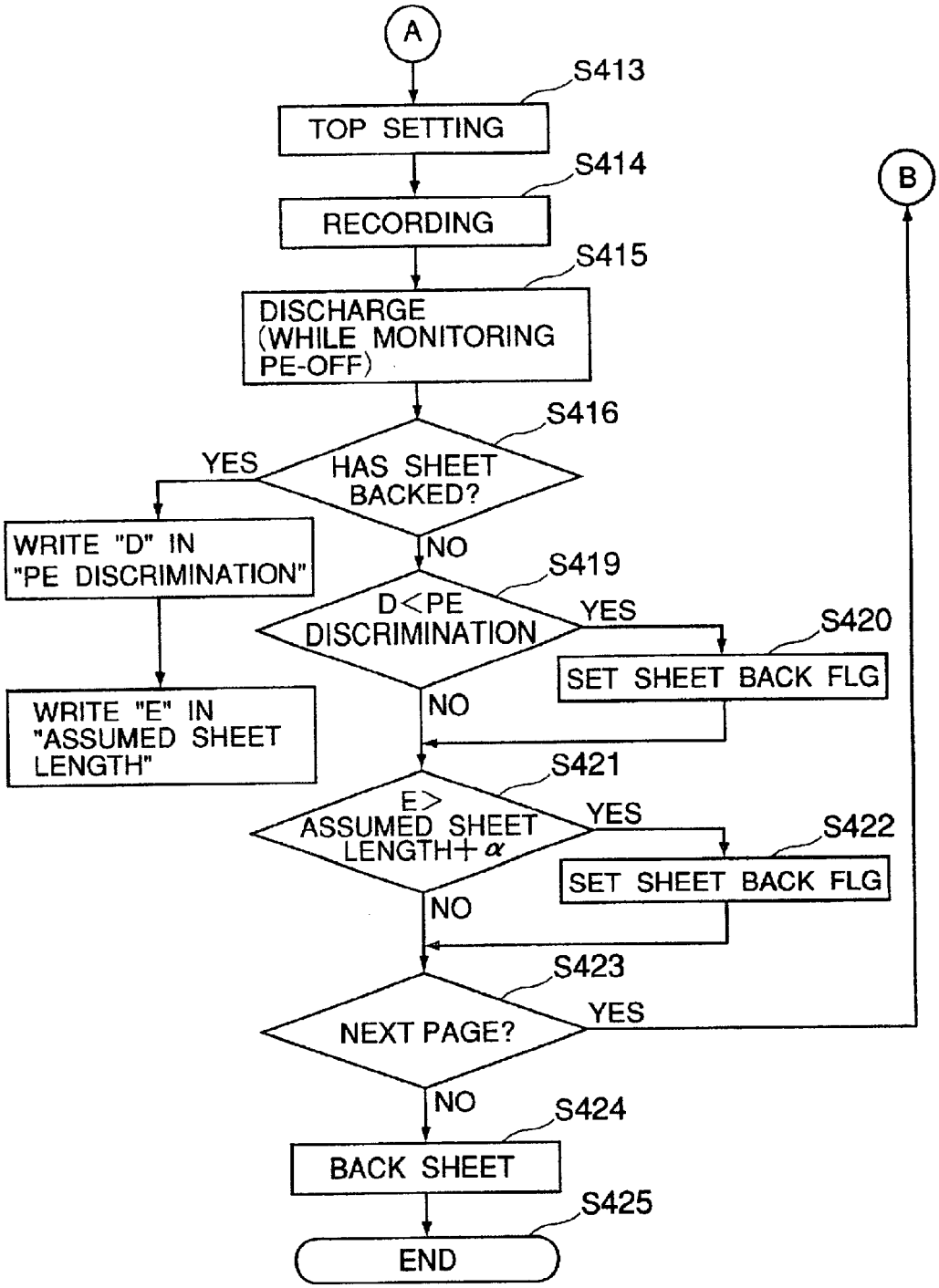
FIG. 7 is a flow chart of a part of a recording operation control of the recording device.

FIGS. 6 and 7 are flow chart of a sheet feeding operation in a recording device which is an example of the image forming apparatus according to a second embodiment of the present invention. In this Figure, steps S401–S415 and S419–S425 are the same as steps S301–S315 and S316–S322 of FIGS. 4 and 5.

In this embodiment, the sheet free end detection timing at the time of the immediately previous sheet returning operation after the sheet discharge (S415) is stored (A), and B (proper margin is added) provided by deducting C shown in FIG. 2 therefrom is stored as "PE discrimination value" (S417).

In this embodiment, immediately after the sheet returning operation, double feeding does not tend to occur, that is, the sheet tends to be fed correctly. More particularly, the data E corresponding to the measured sheet length upon the latest sheet returning operation is stored as "supposed sheet length" in the RAM 1*d* which functions as sheet length storing means. The liability of the double feeding may be detected on the basis of comparison between the detecting timing of the leading-edge of the sheet after the separating operation and detecting timing of the leading-edge of the sheet after the separating operation after the previous sheet returning stored in the RAM 1*d*. By doing so, the detection error attributable to the difference in the stack amount can be avoided by a simple structure.

In an alternative, the double feeding may be detected by comparison between the supposed sheet length and the actually measured sheet length. By doing so, the sheet length data to be provided from the host computer or the like are not necessarily.

In the foregoing description, the data supplied from the host computer are related with the sheet length, but the present invention is not limited to this example, and the data supplied from the host computer may be the recording range data which corresponds to the length not including the front and rear margins. In such a case, the actually measured sheet length should not include the margins. Alternatively, the recording range which is counted as a value required for the recording may be measured, and the measurement may be used.

In the foregoing, the description has been made as to the apparatus in which the leading edge of the sheet is abutted to the feeding rollers which are at rest to effect registration with image to be recorded. The same applies to the case in which the leading edge of the sheet is abutted to feeding rollers which are rotated in the opposite directions to effect the registration. In the apparatus in which no registering operation is carried out, the position of the leading edge of the sheet in the measured length is on the basis of the leading-edge detection by the sheet end sensor 1*f*. The structure for the comparison between the measured sheet length and the supposed sheet length is the same.

In the foregoing, the description has been made as to an example in which the supposed sheet length can be obtained from the host computer as the recording apparatus. However, in the case of stand-alone type machine such as a copying machine, the machine detects and sets the size of the sheets set in the apparatus, and in such a case, the data may be used for the supposed sheet length.

In the foregoing, the sheet returning operation is carried out on the basis of the detection of the leading edge of the sheet before the start of sheet feeding, by the sheet end detection sensor 1*f*. In an alternative, a sensor exclusively for detection of the presence or absence of the sheet slightly downstream of the roller 6, and when the sensor detects the presence of the sheet before the sheet feeding, the sheet returning may be carried out before the next sheet feeding.

In the foregoing, the description has been made as to the friction separating type in which the use the spade with the half-moon roller and the roller for double feeding prevention, but the present invention is not limited to this example of the separation type. The similar advantageous effects can be provided irrespective of the separating type, if the sheet returning operation can be selectively carried out, and the detection timing of the leading edge of the sheet and the detection of the sheet length are possible. In the foregoing Embodiments, the sheet feeding it started only by the rotation of the sheet feeding motor 15, but the present invention is applicable to the structure in which they use is made with a latch for permitting one full rotation in the fourth direction by a small backward rotation.

In the foregoing examples, the separation of the sheet feeding roller 2 and the sheet, and the feeding of the sheet are completed through one full rotation of the sheet feeding roller 2, but the present invention is not limited to such examples. For example, sheet feeding can be made with a circular roller and a hopper raising and lowering mechanism which are driven to separately. In this case, the similar control operations are carried out at the timing of detection of the leading edge of the sheet on the basis of the rising over the hopper. By doing so, the similar advantages effects are provided. The structure relating to the sheet length is applicable irrespective of the structure of the separating portions.

In the foregoing embodiments, the sheet feeding roller 2 and the feeding rollers are driven by different motors, but they may be driven by the same motors. The motors used in the foregoing embodiments are stepping motors, but other types of motors are usable if the feeding distance can be detected. An example of such motors are a combination of a DC motor and an encoder.

As described in the foregoing, according to embodiments, the returning means is operated to carry out the sheet returning operation when the position of the leading edge of the sheet other than the sheet single out by the separating means is downstream of the stop position of the separating means. Thus, the rest of the sheets can be returned to the sheet stacking means, thereby to avoid the double feeding, without losing the sheet feeding speed.

What is claimed is:

1. A sheet feeding apparatus comprising:

sheet stacking means for stacking sheets;

sheet feeding means for feeding the sheets from said stacking means;

separating means for separating the sheets one by one as the sheets are fed from said sheet stacking means; and returning means for returning to said sheet stacking means each fed sheet other than the sheets separated by separating means;

sheet detecting means for detecting a leading-edge of the sheet separated by said separating means; and control means for controlling said returning means to return the sheet in accordance with a timing of said sheet detecting means detecting the leading-edge of the sheet separated by said separating means.

2. An apparatus according to claim 1, wherein said sheet detecting means detects an amount of operation of said sheet feeding means until said sheet detecting means detects the leading edge of the sheet, and said control means discriminate whether to operate said returning means in accordance with an output of said detecting means.

3. An apparatus according to claim 2, further comprising sensor change detecting means for detecting an on-off state of said sheet feeding means, wherein detection of the amount of the operation of said sheet feeding means is started on the basis of the information from said sensor change detecting means.

4. An apparatus according to claim 2, further comprising storing means for storing the amount of the operation of said sheet feeding means until said sheet detecting means detects a leading edge of the sheet immediately after the sheet returning operation, wherein said sheet detecting means detects an amount of operation of said sheet feeding means until said sheet detecting means detects the leading-edge of the sheet, and said control means discriminates whether to operate said returning means in accordance with a comparison between the amount of operation stored in said storing means and an output of said detecting means.

5. An apparatus according to claim 1, wherein said separating means is of a friction separating type and is provided with a friction element, and a roller for confining the leading edge of the sheet other than the sheet separated by said separating means, by contact to said separating means.

6. An apparatus according to claim 2, wherein said sheet feeding means is driven by a stepping motor, and the amount of the operation of said sheet feeding means is detected by number of pulses of the stepping motor.

7. An apparatus according to claim 2, wherein a driving system for said sheet feeding means includes an encoder, and the amount of the operation of said sheet feeding means is detected on the basis of a detected value of the encoder.

8. A sheet feeding apparatus comprising:

sheet stacking means for stacking sheets;

sheet feeding means for feeding the sheets from said sheet stacking means;

separating means for separating the sheets one by one as the sheets are fed from said sheet stacking means;

returning means for returning to said sheet stacking means each fed sheet other than the sheets separated by separating means; and sheet detecting means for detecting a leading-edge and a trailing-edge of the sheet separated by said separating means; and control means for controlling said returning means in accordance with a length of the sheet calculated by said sheet detecting means.

9. An apparatus according to claim 8, further comprising storing means for storing a length of the sheets stacked on said sheet stacking means, wherein said control means discriminates whether to operate said returning means in accordance with a comparison between the length of the sheet calculated by said sheet detecting means and the length of the sheet stored in said storing means.

10. An apparatus according to claim 8, wherein the length of the sheet is calculated on the basis of the amount of operation of said sheet feeding means to detection of a trailing-edge of the sheet of said sheet detecting means.

11. An apparatus according to claim 8, further comprising storing means for storing a length of the sheet immediately after a sheet returning operation of said returning means, wherein said control means discriminates whether to operate said returning means in accordance with a comparison between the length of the sheet calculated by said sheet detecting means and the length of the sheet stored in said storing means.

12. An apparatus according to claim 8, wherein a driving source for said sheet feeding means is a stepping motor, and wherein the length of the sheet is calculated on the basis of the number of pulses of the stepping motor.

13. An apparatus according to claim 8, further comprising an encoder in a driving system for said feeding means, wherein the length of the sheet is calculated on the basis of an output of the encoder.

14. A sheet feeding apparatus comprising:

a sheet stacking portion for stacking sheets;

a sheet feeding roller for feeding the sheets stacked on said sheet stacking portion;

a separation portion for separating the sheets one by one as the sheets are fed from said sheet stacking portion; and a returning claw for returning to said sheet stacking portion a sheet other than the sheet separated by said separation portion;

sheet detecting means for detecting a leading-edge of the sheet separated by said separation portion; and control means for controlling said returning means to return the sheet in accordance with a timing of said sheet detecting means detecting the leading-edge of the sheet separated by said separating means.

15. An apparatus according to claim 14, wherein said sheet detecting means detects an amount of an operation of said sheet feeding roller until said sheet detecting means detects the leading-edge of the sheet, and said control means discriminates whether to operate said returning claw in accordance with an output of said detecting means.

16. An apparatus according to claim 15, further comprising a sensor change detection portion for detecting an on-off state of said sheet feeding roller, wherein detection of the amount of the operation of said sheet feeding roller is started on the basis of information from said sensor change detection portion.

17. An apparatus according to claim 15, further comprising storing portion for storing an amount of operation of said sheet feeding roller to detection of the leading edge of the sheet by said sheet detection portion immediately after a sheet returning operation, wherein said sheet detecting means detects an amount of an operation of said sheet feeding roller until said sheet detecting means detects the leading-edge of the sheet, and said control means discriminates whether to operate said returning claw in accordance with a comparison between the amount of operation stored in said storing means and an output of said detecting means.

18. An apparatus according to claim 14, wherein said separating means is of a friction separating type and is provided with a friction element, and a roller for confining the leading edge of the sheet other than the sheet separated by said separating means, by contact to said separating means.

19. An apparatus according to claim 15, wherein a driving source for said sheet feeding means is a stepping motor, wherein the length of the sheet is calculated on the basis of the number of pulses of the stepping motor.

20. An apparatus according to claim 15, further comprising an encoder in a driving system for said sheet feeding means, wherein the length of the sheet is calculated on the basis of an output of the encoder.

21. A sheet feeding apparatus comprising:

a stacking portion for stacking sheets;

a sheet feeding roller for feeding the sheets stacked on said sheet stacking portion;

a separation portion for separating the sheets one by one as the sheets are fed from said sheet stacking portion;

a returning claw for returning to said sheet stacking portion a sheet other than the sheet separated by said separation portion; and a sheet detection portion for detecting a leading-edge and a trailing-edge of the sheets separated by said separation portion; and control means for controlling said returning means in accordance with a length of the sheet calculated by said sheet detecting means.

22. An apparatus according to claim 21, further comprising a storing portion for storing a length of the sheet stacked on said sheet stacking portion, wherein said control means discriminates whether to operate said returning claw in accordance with a comparison between the length of the sheet calculated by said sheet detecting means and the length of the sheet stored in said storing portion.

23. An apparatus according to claim 21, wherein the length of the sheet is calculated on the basis of an amount of operation of said sheet feeding roller to detection of the trailing edge of the sheet by said sheet detecting means.

24. An apparatus according to claim 21, further comprising a storing portion for storing the length of the sheet immediately after the sheet returning operation of said returning claw, and wherein said control means discriminates whether to operate said returning claw in accordance with a comparison between the length of the sheet calculated by said sheet detecting means and the length of the sheet stored in said storing portion.

25. An apparatus according to claim 21, wherein a driving source for said sheet feeding means is a stepping motor, and wherein the length of the sheet is calculated on the basis of the number of pulses of the stepping motor.

26. An apparatus according to claim 21, further comprising an encoder in a driving system for said sheet feeding means, wherein the length of the sheet is calculated on the basis of an output of the encoder.

27. A recording device for effecting recording on a sheet by a recording head, said apparatus comprising:

a head carrying portion for carrying the recording head;

sheet stacking means for stacking sheets;

sheet feeding means for feeding the sheets from said sheet stacking means;

separating means for separating the sheets one by one as the sheets are fed from said sheet stacking means; and returning means for returning to said sheet stacking means each fed sheet other than the sheet separated by separating means;

sheet detecting means for detecting a leading-edge of the sheet separated by said separating means; and control means for controlling said returning means to return the sheet in accordance with timing of said sheet detecting means detecting the leading-edge of the sheet separated by said separating means.

28. A recording apparatus for effecting recording on a sheet by a recording head, said apparatus comprising:

a head carrying portion for carrying the recording head;

sheet stacking means for stacking sheets;

sheet feeding means for feeding the sheets from said sheet stacking means;

separating means for separating the sheets one by one as the sheets are fed from said sheet stacking means;

returning means for returning to said sheet stacking means each fed sheet other than the sheet separated by separating means;

sheet detecting means for detecting a leading-edge and a trailing-edge of the sheet separated by said separating means; and control means for controlling said returning means in accordance with a length of the sheet calculated by said sheet detecting means.

29. A recording device for effecting a record on a sheet by a recording head, said apparatus comprising:

a head carrying portion for carrying the recording head;

a sheet stacking portion for stacking sheets;

a sheet feeding roller for feeding the sheets stacked on said sheet stacking portion;

a separation portion for separating the sheets one by one as the sheets are fed from said sheet stacking portion; and a returning claw for returning to said sheet stacking portion a sheet other than the sheet separated by said separation portion;

sheet detecting means for detecting a leading-edge of the sheet separated by said separation means; and control means for controlling said returning claw to return the sheet in accordance with timing of said sheet detecting means detecting the leading-edge of the sheet separated by said separating means.

30. A recording apparatus for effecting recording on a sheet by a recording head, said apparatus comprising:

a head carrying portion for carrying the recording head;

a sheet stacking portion for stacking sheets;

a sheet feeding roller for feeding the sheets stacked on said sheet stacking portion;

a separation portion for separating the sheets one by one as the sheets are fed from said sheet stacking portion;

a returning claw for returning to said sheet stacking portion a sheet other than the sheets separated by said separation portion;

a sheet detection portion for detecting a leading-edge and a trailing-edge of the sheet separated by said separation portion; and control means for controlling said returning claw in accordance with a length of the sheet calculated by said sheet detecting means.

31. A recording apparatus for effecting recording on a sheet by a recording head, said apparatus comprising:

a head carrying portion for carrying the recording head;

a stacking portion for stacking sheets;

a roller for feeding the sheets stacked on said stacking portion;

a stepping motor for driving said roller;

a separation portion for separating the sheets one by one as the sheets are fed from said stacking portion;

a sensor for detecting a leading edge of a sheet;

a returning claw for returning to said stacking portion a sheet other than the sheet separated by said separation portion;

control means for operating said returning claw in accordance with a number of pulses of said stepping motor from start of rotation of said roller to said to sensor detecting the sheet.

32. A recording apparatus for effecting recording on a sheet by a recording head, said apparatus comprising:

a head carrying portion for carrying the recording head;

a stacking portion for stacking sheets;

a roller for feeding the sheets stacked on said stacking portion;

a stepping motor for driving said roller;

a separation portion for separating the sheets one by one as the sheets are fed from said stacking portion;

a sensor for detecting a leading edge and a trailing edge of a sheet;

a returning claw for returning to said stacking portion a sheet other than the sheet separated by said separation portion; and control means for operating said returning claw in accordance with a number of pulses of said stepping motor from said sensor detecting the leading edge of the sheet to said sensor detecting the trailing edge of the sheet.

* * * * *

UNITED STATES PATENT AND TRADEMARK OFFICE

CERTIFICATE OF CORRECTION

PATENT NO. : 6,874,778 B2
DATED : April 5, 2005
INVENTOR(S) : Yuji Nakano et al.

It is certified that error appears in the above-identified patent and that said Letters Patent is hereby corrected as shown below:

Title page,
Item [56], References Cited, U.S. PATENT DOCUMENTS, "5,672,019 A 9/1997 Hiramatus et al." should read -- 5,672,019 A 9/1997 Hiramatsu et al. --.

Column 3,
Line 43, "potion" should read -- portion --.

Column 6,
Line 1, "passes" should read -- pass --.

Column 8,
Line 51, "chart" should read -- charts --.

Column 9,
Line 13, "necessarily." should read -- necessary. --.
Line 50, "use" should read -- use of --.
Line 59, "they" should read -- the --.

Column 10,
Line 4, "advantages" should read -- advantageous --.
Line 15, "single" should read -- singled --.
Line 40, "nate" should read -- nates --.

Column 14,
Line 37, "to" (2nd occurrence) should be deleted.

Signed and Sealed this

Ninth Day of August, 2005

JON W. DUDAS
*Director of the United States Patent and Trademark Office*